United States Patent [19]

Landa et al.

[11] Patent Number: 4,536,230

[45] Date of Patent: Aug. 20, 1985

[54] ANISOTROPIC PERMANENT MAGNETS

[75] Inventors: Vaclav Landa; Zdenek Blazek, both of Prague, Czechoslovakia

[73] Assignee: Stani vyzkumny ustav materialu, Prague, Czechoslovakia

[21] Appl. No.: 274,413

[22] Filed: Jun. 17, 1981

Related U.S. Application Data

[63] Continuation-in-part of Ser. No. 129,428, Mar. 12, 1980, abandoned.

[30] Foreign Application Priority Data

Mar. 13, 1979 [CS] Czechoslovakia ..... 1661-70

[51] Int. Cl.[3] ..... H01F 1/04

[52] U.S. Cl. ..... 148/31.57; 335/306

[58] Field of Search ..... 148/103, 108, 31.57; 335/284, 303, 306; 361/143

[56] References Cited

U.S. PATENT DOCUMENTS

| | | | |
|---|---|---|---|
| 2,393,466 | 1/1946 | Greenfield | 335/284 |
| 2,602,840 | 7/1952 | McKee et al. | 335/284 |
| 3,454,913 | 7/1969 | Israelson et al. | 335/306 |
| 3,610,583 | 10/1971 | Ostrom | 335/306 |
| 3,781,736 | 12/1973 | Parker | 335/306 |
| 4,185,262 | 1/1980 | Watanabe et al. | 335/303 |
| 4,222,021 | 9/1980 | Bunker | 335/303 |
| 4,271,782 | 6/1981 | Bate et al. | 335/284 |

FOREIGN PATENT DOCUMENTS

| | | |
|---|---|---|
| 961725 | 6/1964 | United Kingdom . |
| 1424659 | 2/1976 | United Kingdom . |
| 2057194A | 3/1981 | United Kingdom . |

*Primary Examiner*—John P. Sheehan

[57] ABSTRACT

A permanent magnet made of a rigid material, said magnet having, within its entire body or in a part thereof, an anisotropic magnetic structure wherein the axes of easy magnetization in the elementary magnet regions have a convergent orientation in the environment of at least one of magnet poles. The value of magnetic induction to be delivered by the magnet of the invention to an air gap, or other part of magnetic circuit is raised relative to conventional anisotropic permanent magnets made of the same materials.

18 Claims, 21 Drawing Figures

ANISOTROPIC PERMANENT MAGNETS

Figure 1A:
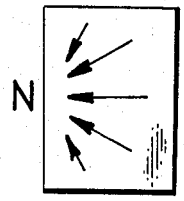

This application is a continuation-in-part of application Ser. No. 129,428, filed Mar. 12, 1980 abandoned.

The present invention relates to permanent magnets made of rigid material, said magnets having a magnetic structure which raises the value of magnetic induction supplied into an air gap or into other parts of a magnetic circuit.

In a plurality of applications, it is one of the main tasks of permanent magnets to produce as high magnetic an induction in a magnetic circuit as possible. For this purpose there have heretofore been used anisotropic permanent magnets which, if compared with isotropic magnets made of the same materials, exhibit a substantially more advantageous magnetic curve behavior. The hitherto manufactured anisotropic magnets made of rigid material are characterized in that their elementary constituents, viz. powder particles, crystals, or the like, are all oriented in the magnet body by their axes of easy magnetization in one and the same direction, i.e. in the direction in which the permanent magnet is magnetized. Such an anisotropic magnetic structure makes it psosible to achieve for a given material the maximum value of remanence and /BH/max product, and a correspondingly increased magnetic induction value at an operating point. To obtain such structure there are used processes of orienting powder particles by means of a magnetic field, crystallizing at a controlled temperature gradient, heat treating in a magnetic field, extruding, rolling, and many others. The present technological standard of permanent magnet production enables such magnets to be manufactured with almost perfect orientation of this type so that there does not practically exist any possibility to attain in this way a substantial increase in the magnetic induction value. Needless to say, this fact prevents a desirable rise of parameters in a plurality of various appliances using previously existing permanent magnets.

It is an object of the invention to eliminate the above-mentioned drawbacks of the prior art and to provide anisotropic permanent magnets made of rigid material according to the invention in which the entire body of the magnet or a part thereof has a non-homogeneous structure the orientation of which, in the region of the pole to produce an increased magnetic induction, is convergent.

The anisotropic structure is provided by orienting the axes of easy magnetization of the elementary magnet regions so as to follow the desired directions. Such an orientation optimalizes the magnetic induction behavior outside the magnet in the pole environment unlike the hitherto used permanent magnets which are substantially oriented so as to obtain an optimum magnetic induction behavior in the magnet body interior. Due to the magnet structure orientation according to the invention, the magnetic flux is concentrated in the surface region of one or more poles into a smaller cross-section than that of the magnet; within such a decreased cross-section an increased magnetic induction is delivered to an external empty (air gap) or filled-up space. This convergent structure raises further the magnetic induction in that it reduces leakage and fringing flux. As the attached drawings demonstrate, the present invention relates to permanent magnets, the poles of which of opposite polarity or the centers of surfaces of said poles are on opposite sides of the magnets.

The increased magnetic induction can be delivered, for instance, to an operative air gap portion, a pole piece, or to another part of the magnetic circuit. To achieve the above-mentioned increase of magnetic induction value on the surface of a reduced pole area, the structure of magnets according to the invention possesses a convergent orientation even with respect to normals to the magnet pole surface. It is why, for example, radially oriented toroids and segments wherein the orientation follows the directions of normals to the entire pole surface, cannot be considered to be magnets with convergent structure as hereinabove disclosed.

Among the magnets forming the subject matter of the invention there should not be further comprehended magnets having two poles of opposite polarities at one and the same side, such magnets being oriented along the direction of lines of force connecting said poles, which direction corresponds to the direction of magnetization. With the claimed magnets, the convergent orientation is created artificially so that the lines of force are compressed into a smaller cross-section than that of the magnet. Some types of convergent orientation structures which are preferable for this purpose are hereinafter described or shown in the drawings. The anisotropic magnets according to the invention possess many advantages over the existing ones. Among them there can be particularly named an increase of the maximum magnetic induction values attained in the air gap without the use of pole pieces, when compared with the conventional magnets. Apart from this, the permanent magnets according to the present invention produce a higher magnetic induction at a greater distance from the magnet surface. Nevertheless they can also deliver a higher magnetic induction to the air gap or another magnetic circuit part by means of pole pieces made of soft iron, permendur, or any other suitable material.

The advantages as hereinabove referred to can be availed of in a plurality of practical applications. An increase of magnetic induction in the air gap improves the parameters of generators, motors, engines, driving appliances with permanent magnets, magnetic clutches, bearings, separators, clamping elements, relays, pick-ups, micro-wave elements, electro-acoustic transducers or the like, such parameters being, for instance, higher efficiency, output, torque, attractive or repulsive force effects, sensitivity, precision and lower power demand. Another outstanding merit of the present invention lies in various possibilities of miniaturization of magnetic circuitry or of enlarging the air gap, when compared with the applications of the heretofore used permanent magnets, without effecting the magnetic induction values. This results in many cases in a reduction of material costs, a longer lifetime, a simplified structure, and easier manufacture.

Thus, it is made possible, for example, to substitute plain magnets of the invention with an increased induction in the air gap for existing magnets having pole pieces made from soft iron or permendur. Apart from miniaturization, the magnets of the invention without pole pieces bring about improvements in dynamic characteristics in magnetic circuitry with moveable operating parts.

The permanent magnets according to the invention can be preferably manufactured from most of the heretofore known magnetically hard materials. A new and higher effect is particularly achieved with these magnets when using materials with relative high coercive force values and further those exhibiting magnetic anisotrophy in elementary regions (viz. e.g. magnetocrystalline anisotropy) since it is necessary—when concentrating the magnetic induction lines—to overcome repulsive forces and demagnetization effects. By way of example, there can be named materials based upon rare earths, ferrites, Alnico materials with high coercive forces, PtCo, MnBi and so forth. In case the magnet is coupled with an appropriate pole piece or with another magnetic part of a magnetic circuit it is possible even to employ magnetically hard materials having lower coercive force and elementary magnetic anisotrophy characteristics. The anisotropically oriented structure of the magnets or parts thereof according to the invention can be produced by employing analogous techological processes of orientation of elementary regions as availed of in the manufacture of conventional anisotropic magnets.

In case the magnets of the invention are made of barium of strontium ferrites the magnetic induction is enhanced inasmuch as such magnets, in some applications, can replace substantially more expensive magnets made on the basis of rare earths. On the other hand, when using for the manufacture of magnets of the invention materials based on rare earths, such as, $SmCo_5$, there are obtained increased magnetic induction valves in the air gap that are unattainable with any of the hitherto used permanent magnets without pole pieces. Thus, the process of manufacturing magnets according to the invention makes it possible effectively to reevaluate starting materials for permanent magnets.

The mostly preferred embodiments of the anisotropic structure with permanent magnets according to the invention depend, in the particular spheres of application, upon the configuration of the magnetic circuit and of the air gap, and further on the claims laid upon the value and spatial distribution of magnetic induction in the air gap and in other portions of magnetic circuit, and finally on the shape, dimensions and magnetic characteristics of the particular permanent magnet material.

Figure 2A:
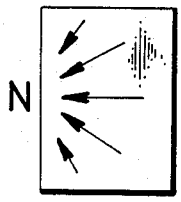
Figure 2B:
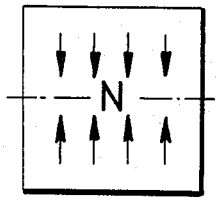
FIG.2b PRIOR ART
Figure 3A:
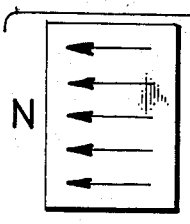
Figure 3B:
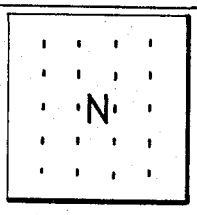
Figure 9A:
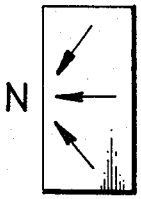
Figure 9B:
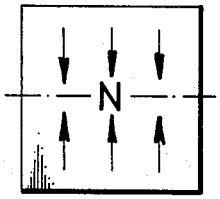

In order that the present invention may be better understood and carried into practice, some preferred embodiments thereof will hereinafter be described by way of example with reference to accompanying schematic drawings, in which:

FIGS. 1, *a* and *b*, 2, *a* and *b*, and 4 through 8 are views in section of permanent magnets having the anisotropic orientation according to the invention;

FIGS. 3*a*, and 3*b*, which are labelled "Prior Art", are analogous views of a conventional homogeneously oriented anisotropic permanent magnet;

FIG. 9*a* is a view analogous to FIG. 1*a* of a composite anisotropic magnet in accordance with the invention;

FIG. 9*b* is a view analogous to FIG. 2*b* of the composite anisotropic magnet of FIG. 9*a;*

Figure 10A:
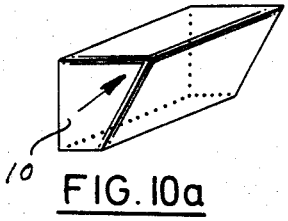
Figure 10B:
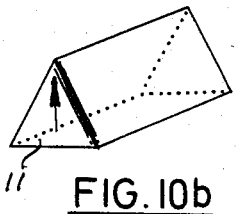
Figure 10C:
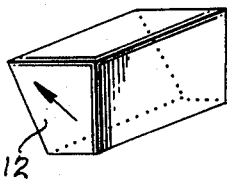
FIG.10c PRIOR ART

FIGS. 10*a*, 10*b*, and 10*c* are views in perspective of the parts making up the magnet of FIGS. 9*a* and 9*b;*

Figure 11:
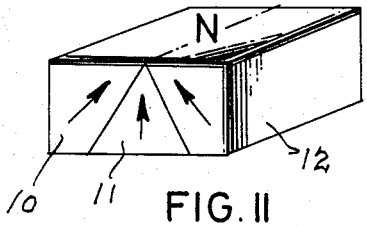

FIG. 11 is a view in perspective of the magnet of FIGS. 9*a* and 9*b;*

Figure 1B:
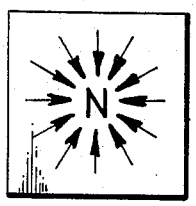
Figure 12A:
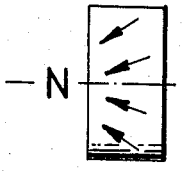
Figure 12B:
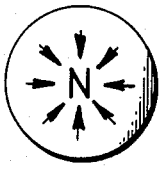
Figure 13A:
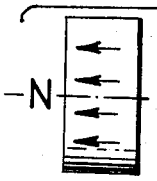
Figure 13B:
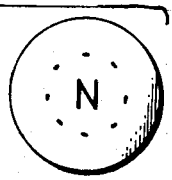

FIGS. 12*a* and 12*b* are views analogous to FIGS. 1*a* and 1*b* of a cylindrical anisotropic magnet in accordance with the invention, and FIGS. 13*a* and 13*b*, which are labelled "Prior Art", are views similar to FIGS. 12*a* and 12*b* of a conventional cylindrical homogeneously oriented anisotropic permanent magnet.

A permanent magnet in the form of a prism as shown in the drawings has an anisotropic structure which enables an increased magnetic induction value to be attained in the outer space in the proximity of the magnet. FIGS. 1, *a* and *b* and FIGS. 2, *a* and *b*, show such variants of orientation which increase the magnetic induction in the region of pole N center area adjacent the air gap (see FIGS. 1, *a* and *b*) and along an axis passing through the center of this area (see FIGS. 2, *a* and *b*). The orientation is indicated by arrows pointing toward the pole N. FIGS. 1*a* and 2*a* show the anisotropic structure in a sectional view taken in parallel to the magnet axis pointing to the N pole while FIGS. 1*b* and 2*b* in the view taken perpendicular to the pole area. As proved by measurements, the afore-described orientation exhibits a substantial increase of magnetic induction when compared with conventional anisotropic permanent magnets.

Figure 4:
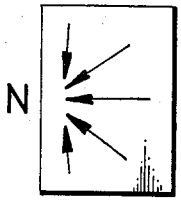
Figure 5:
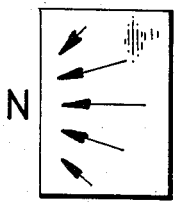

A magnet in the form of a cube made of strontium ferrite was subjected to the measurement of a magnetic induction component perpendicular to the pole area by means of a Hall probe applied close to the center of the area. While with an orthodox anisotropic magnet having a homogeneous orientation (see FIG. 3) tho induction value of 0.15 T was found, a magnet made of the same material and oriented as shown in FIGS. 2, *a* and *b*, exhibited a magnetic induction value of 0.32 T. The structure of the magnets according to the present invention can be oriented so as to achieve the maximum rise of magnetic induction but in a relatively small space and at a close proximity to the magnet surface (see FIG. 4), or to achieve a relatively smaller induction increase but in a larger space and also at a longer distance from the magnet surface (see FIG. 5).

Figure 6:
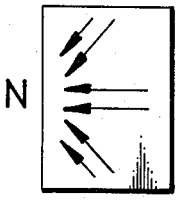
Figure 7:
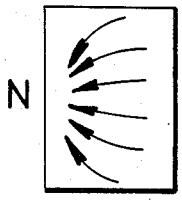
Figure 8:
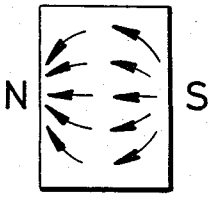

The changes of directions of orientation in the convergent anisotropic structure can take place in the magnet body uniformly and continuously as shown in the above-described figures such as, FIG. 1*a*, or, on the other hand, discontinuously or by jumps as apparent in FIG. 6. The convergent orientation directions follow linear path, that is the convergent orientation is linear (see e.g. FIG. 1*a*), or curvilinear, as along convex curves (see FIG. 7). Magnets shown in FIGS. 1, 2 and 4 through 7 can preferably deliver an increased magnetic induction not only immediately into the air gap but also into a pole piece of, as a rule, smaller cross-section than that of the magnet body, said piece being disposed in the central region of the pole area where the magnetic flux is concentrated. Similarly as a pole piece, also another part of magnetic circuit can be attached to the magnet. The convergent anisotropic structure can be analogously provided on the opposite pole. FIG. 8 shows, by way of example, a curvilinear structure affecting both North and South poles.

The above exemplary embodiments illustrate fundamental principles of the invention but are far from disclosing all of the various configurations of anisotropic structures which may be given to the magnets and designed for raising the values of the magnetic induction the magnet is to deliver. Magnets of convergent structure can possess various shapes as usual in and desired by pyramids, cones, rings, rods, U-, C-, E-shaped magnets, and intricate as well as irregular shapes provided with apertures, notches, and projections. The anisotropic convergent structure can be produced in the region of one, two or more poles, in a portion, in separate regions of or in the entire magnet body; further the structure can have a linear, curvilinear, continuous, or gradual, two- or three-dimensional configuration. Such an anisotropic structure can follow any magnetization direction where—in accordance with particular application—it is necessary to increase the magnetic induction value delivered. The anisotropic permanent magnets according to the present invention can be manufactured in several modes.

In one of these modes, the final magnet is made by connecting parts 10, 11, and 12 (FIGS. 10*a*, 10*b*, and 10*c* prepared from existing oriented materials for permanent magnets), which parts by their shapes and dimensions complement one another so as to obtain the form and size of the final magnet, shown in FIG. 11. Parts 10, 11, and 12 are prepared from existing oriented materials for permanent magnets, which parts by their shapes and dimensions complement one another so as to obtain the form and size of the final magnet shown in FIG. 11, the respective establishment of converging axes of easy magnetization which comprises two or more convergent sources being produced in such a manner that with at least two adjacent parts the magnetic orientations are inclined to each other while the magnetization polarities point toward one and the same pole.

For example, the individual parts can be oriented homogeneously. For the manufacture of homogeneously oriented parts of the final magnet, well-known processes of manufacturing existing anisotropic magnets can be used. As an example there can be named processes of manufacturing anisotropic powder magnets pressed in combination with a binder, or sintered, or cast anisotropic magnets.

To produce homogeneously oriented powder magnets made, for example, from hard ferrites, rate earth cobalt or Alnico materials, one must have a powder consisting mostly of single crystals and these must be aligned with their crystallographic axes of easy magnetization parallel. This is usually done by presaturating the powder particles and applying homogeneous magnetic field to orient them before compaction by pressing. Hard magnetic ferrites, properly ball-milled, break into basal-plane platelets which can be also homogeneously oriented by mechanical means such as rolling or extruding without the aid of magnetic field. Homogeneously oriented cast magnets as, e.g., Alnico, are manufactured by casting the material at a high temperature in a mold with heated side walls but chilled bottom face so as to produce a casting with elongated columnar grains in which one of the crystalographic axes of easy magnetization in every grain is nearly parallel.

Another known process of producing homogeneously oriented cast or powdered magnets as, for instance, on the basis of Alnico or Fe-Cr-Co, is the so-called thermomagnetic treatment which consists in applying strong magnetic field during a heat treatment. Such a process establishes a direction of easy magnetization in the permanent magnet material in the axis of magnetic field treatment with a correspondingly dramatic improvement in magnetic properties in this axis and considerably reduced magnetic properties in other axes.

The necessary shapes of the parts are obtained either in a direct process by using appropriate press dies, casting molds and like devices, or by machining homogeneously oriented magnets of different forms as, e.g., by cutting and grinding. The parts can be fixedly attached to each other to produce the final magnet having a convergent orientation; this can be effected by applying various mounting methods such as encasing, screwing, framing, cementing, soldering and the like.

It is to be understood that the parts can be connected together in different phases of the final magnet manufacture. Thus, for instance, in the manufacture of sintered powder magnets, there can be either joined parts of the final sintered material, or powder pressings which are not sintered until fused into a complex. Thus the parts can be constituted by final permanent magnets, or semi-products thereof. For another example there may serve cast magnets wherein the parts can be joined before as well as after heat treatment. The parts can be further connected with each other either in the magnetized or demagnetized state. In the former case, repulsion forces have to be mastered whereas in the latter case it should be secured that the final magnet be magnetized to a convertent orientation.

The permanent magnets with convergent orientation can be manufactured in the claimed process preferably from most types of hitherto known magnetically hard materials. As examples there may be named magnetically hard ferrites, rare earth based materials, AlNiCo, PtCo, MnAl, MnBi and so forth. The manufactured final magnets can be of most various shapes and the convergently oriented structures can possess most various characteristics as referred to in the specification. The forms and dimensions of the individual parts are to be chosen so as to give after the fusion a magnet of the required form and size. The parts can have various shapes such as prisms, pyramids, cones, annuli and other solids.

To establish converging axes of easy magnetization comprising two or more different convergent orientation courses, the parts are oriented so that the orientations of adjacent parts be inclined to each other, and magnetized so that the corresponding polarities point toward one and the same pole. The angles of inclination and the number of parts with mutually inclined orientations are to be chosen depending upon the requested convergency degree and upon the requested number of different orientation courses in the convergent structure of final magnet.

The claimed process of manfacturing magnets has many advantages. Particularly it is advantageous that the process makes it possible to manufacture magnets having various convergently oriented structures according to claims laid on the final magnet parameters. Among these structures there may be comprehended even some extreme cases, the manufacture of which by other modes would be very difficult or even impossible. It is, for example, convergent orientations that maximally concentrate the magnetic flux into a narrow region, or magnets having intricate shapes, or a plurality of pole. As starting materials it is possible to use currently available anisotropic magnetically hard materials, or final magnets. Also, the necessary manufacturing plants are relatively simple and inexpensive. For these reasons the claimed process can be even realized by magnet users which are not equipped with means for mass production of magnets.

An alternative method of manufacturing magnets according to the present invention consists in the establishment of converging axes of easy magnetization in the material by the action of external magnetic field, the lines of force of which have a convergent course in the region in which they act on the material. For the sake of simplicity, such magnetic field will be hereinafter called "convergent magnetic field".

The permanent magnets with convergent orientation can be preferably manufactured in this way also from most of known types of magnetically hard materials, such as magnetically hard ferrites, rare earth-based materials, AlNiCo, PtCo, MnAl, MnBi, and others. A new and higher effect in magnets with convergent orientation is obtained particularly if using materials with relatively high values of coercive forces and of monoaxial magnetocrystal anisotropy.

EXAMPLE

A permanent magnet in the form of a cylinder having 10 mm diameter, a 5 mm height, was made of SmCo-CuFe powder particles of 10 μm average particle size, by pressing the particles together with or without an organic binder. The convergent orientation raises the value of the magnetic induction discharging from the center of cylinder base (pole S). FIG. 12*a* shows an isotropic structure in a sectional view taken parallel to the magnet axis pointing toward the pole while FIG. 12*b* shows the structure in a view taken perpendicular to the pole area. The magnet was pressed in a convergent magnetic pole between poles of an electromagnet of which one pole terminated in an area of 30 mm diameter while the second pole facing the pole S of the permanent magnet to be manufactured, terminated in a conical pole piece having a top area of 2 mm diameter. Maximum magnetic field intensity in the region of the magnet specimen amounted to 640 kA/m. For comparison, there was made a reference magnet specimen having a conventional homogeneous orientation illustrated in FIGS. 13*a* and 13*b*, and prepared from the same material, said specimen having the same dimensions and being pressed under the same conditions, except that the magnetic field of 640 kA/m intensity was homogeneous in the magnet specimen region in the direction of cylinder axis. If compared with the homogeneously oriented magnet, a substantial induction increase in the magnet with the convergent orientation in the central part of the pole S area thereof was found. The induction was measured by Hall probe applied near the central area of pole S. While the homogeneously oriented magnet exhibited the induction of 0.15 T, 30 percent increase of induction was found with the convergently oriented magnet.

The claimed process can find application in the manufacture of both powdered and cast permanent magnets. In the first named case, in the same manner as with orienting by a homogeneous magnetic field, the ferromagnetic or ferrimagnetic powder particles are exposed to the action of magnetic field before or during the pressing process. Powder particles are magnetized in the direction of their axes of easy magnetization. They behave as elementary magnets influenced by torque of an external magnetic field, and take the course of lines of force. Thus the magnetic field displaces the magnetized particles so that their axes of easy magnetization assume the direction of lines of force. After the orientation there will be effected the fixation of the acquired oriented structure by pressing the powder with or without a binder, by sintering, or in other of known manners.

In the manufacture of cast magnets, the convergent magnetic field is applied during the thermomagnetic treatment, viz. cooling the cast piece down from the cast temperature, or cooling it after reheating by exposing the casting to an external magnetic field. The thermomagnetic treatment of permanent magnets by the convergent magnetic field, according to the invention, can be also employed in the manufacture of powdered magnets. In the same manner, as with the thermomagnetic treatment by a homogeneous field, which is usually employed, for example, in the manufacture of cast and powdered Alnico magnets, precipitates, after having passed the Curie temperature, are separated first in the direction of the crystallographic axis which has the smallest deviation from the lines of force of the magnetic field. Thus such a process leads to the creation of the convergently oriented magnetic structure, and is preferred, for example, for thermomagnetically treated both cast and powdered magnets from AlNiCo alloys.

The applied convergent magnetic field can be direct or alternating, stationary or pulsating. In the same manner, as with orienting by a homogeneous field, it is recommended to use, particularly for powder orientation, a magnetic field of as high intensity as possible since the particles during their displacement have, as a rule, to overcome frictional resistance, and apart from this, higher power effects of the magnetic field make it possible to obtain a better orientation. The convergent magnetic field can be produced by various means such as coils, electromagnets, or permanent magnets. As known from magnetostatics, convergent courses are observed with lines of force, for example, in the pole region of a coil, a solenoid, an electromagnet, or a permanent magnet, provided such lines discharged into a relatively large air gap. As another example of convergent magnetic fields, there may be named a field in a small gap between opposite poles of an electromagnet, or a permanent magnet one of the poles of which has a smaller area than the other and concentrates the lines of force coming from the larger area of the second pole. There exist many variants in magnetistatics which lead to the creation of the convergent magnetic field. The claimed process of manufacturing magnets is particularly advantageous in that it enables the manufacture of magnets with convergent orientation practically with the same manufacturing costs as the manufacture of conventional homogeneously oriented magnets. Since it is possible to create various configurations of the lines of force of the convergent magnetic field, it is made possible to manufacture magnets with various corresponding courses of the convergently oriented structures depending upon the demands to be made upon the final magnet parameters.

Apart from the above-mentioned two methods, magnets according to the invention with convergent orientation can be also made in other ways. Thus, for example, cast magnets can be manufactured by controlled crystallization, which means by a properly controlled heat withdrawal when cooling the casting down from the casting temperature. The process is suitable, for instance, for magnets made from AlNiCo alloys having high coercive forces.

Magnets in accordance with the invention may have a variety of shapes, as indicated above. Thus in FIGS. 12*a* and 12*b* there is shown a circular cylindrical magnet which can be employed to advantage in some installations to replace the conventional homogeneously oriented anisotropic permanent magnet illustrated in FIGS. 13*a* and 13*b*.

Although the invention is illustrated and described with reference to a plurality of preferred embodiments thereof, it is to be expressly understood that it is in no way limited to the disclosure of such preferred embodiments, but is capable of numerous modifications within the scope of the appended claims.

We claim:

1. A rigid permanent magnet made of metallic or ceramic material without a plastic matrix, said magnet having within at least a part thereof an anisotropic magnetic structure, wherein the direction of the axes of easy magnetization have a convergent orientation, said orientation concentrating the magnetic flux in the surface region of the pole of the magnet into a smaller cross-section than that of the magnet, and the orientation lines extending from said pole point toward the pole of opposite polarity the area or the center of which are disposed at the opposite magnet side.

2. A permanent magnet as claimed in claim 1, wherein the convergent orientation follows linear paths.

3. A permanent magnet as claimed in claim 1, wherein the orientation direction in the environment of magnet poles converge from more than two sides.

4. A permanent magnet as claimed in claim 1, wherein angular changes in convergent orientation directions take place discontinuously.

5. A permanent magnet as claimed in claim 1, provided with a convergent orientation within the range of one pole which changes into orientation which is divergent in the region at the second pole of opposite polarity, which pole is disposed at the opposite magnet side.

6. A permanent magnet as claimed in claim 1, wherein the convergent orientation is provided in the region of two poles of opposite polarity which poles are disposed at respective opposite magnet sides.

7. A permanent magnet as claimed in claim 1, wherein an angle between the adjacent orientation directions which converge, is less than 90 degrees.

8. A permanent magnet as claimed in claim 1, wherein the magnet is made up of a plurality of initially separate parts which have been separately homogeneously oriented and then assembled.

9. A permanent magnet as claimed in claim 8, wherein said parts have been separately magnetized before assembling.

10. A permanent magnet as claimed in claim 9, wherein each of said initially separate part of the magnet has an edge, each initially separate part of the magnet has been similarly oriented along an axis extending through its said edge, and the magnetized initially separate parts of the magnet are assembled with the said edges thereof closely adjacent to each other so as to present a common magnetic pole.

11. A permanent magnet as claimed in claim 10, having the form of a rectangular prism.

12. A permanent magnet as claimed in claim 1, having the form of a cylinder.

13. A permanent magnet as claimed in claim 1, having the form of a ring or arc.

14. A permanent magnet as claimed in claim 1, made of barium or strontium ferrite.

15. A permanent magnet as claimed in claim 1, made of $SmCo_5$.

16. A permanent magnet as claimed in claim 1, provided with a convergent orientation within the range one pole which changes into orientation which is homogeneous at the second pole of opposite polarity, which pole is disposed at the opposite magnet side.

17. A permanent magnet as claimed in claim 1, wherein the easy magnetization directions in the permanent magnet material are created by the orientation of powder particles by means of a magnetic field, the permanent magnet being exposed to an external magnet field, the lines of force of which have a convergent course in the magnet body portion where the orientation is to be created.

18. A permanent magnet as claimed in claim 1, wherein the easy magnetization directions in the permanent magnet material are created by the orientation of powder particles by means of a thermomagnetic treatment of permanent magnet material, the permanent magnet being exposed to an external magnetic field, the lines of force of which have a convergent course in the magnet body portion where the orientation is to be created.

* * * * *